US012631171B2

(12) United States Patent
Würpel

(10) Patent No.: US 12,631,171 B2
(45) Date of Patent: May 19, 2026

(54) MEMBRANE PUMP DEVICE

(71) Applicant: J. WAGNER GmbH, Markdorf (DE)

(72) Inventor: Hartmut Würpel, Markdorf (DE)

(73) Assignee: J. WAGNER GmbH, Markdorf (DE)

( * ) Notice: Subject to any disclaimer, the term of this patent is extended or adjusted under 35 U.S.C. 154(b) by 235 days.

(21) Appl. No.: 18/066,696

(22) Filed: Dec. 15, 2022

(65) Prior Publication Data

US 2023/0193893 A1 Jun. 22, 2023

(30) Foreign Application Priority Data

Dec. 16, 2021 (DE) ..... 10 2021 133 514.0

(51) Int. Cl.

| | |
|---|---|
| ***F04B 43/073*** | (2006.01) |
| ***F04B 9/113*** | (2006.01) |
| ***F04B 43/067*** | (2006.01) |
| ***F04B 49/22*** | (2006.01) |
| ***F04B 53/10*** | (2006.01) |

(52) U.S. Cl.

CPC ..... *F04B 43/0733* (2013.01); *F04B 9/113* (2013.01); *F04B 43/067* (2013.01); *F04B 49/225* (2013.01); *F04B 53/10* (2013.01)

(58) Field of Classification Search

CPC .... F04B 43/0733; F04B 9/113; F04B 43/067; F04B 49/225; F04B 53/10; F04B 49/03; F04B 17/06; F04B 43/0081; F17D 3/01; F17D 1/20; B05B 9/007; B05B 12/006;

(Continued)

(56) References Cited

U.S. PATENT DOCUMENTS 2,578,746 A * 12/1951 Scherger ..... F04B 43/067 417/388
3,680,981 A * 8/1972 Wagner ..... F04B 43/067 417/388

(Continued)

FOREIGN PATENT DOCUMENTS

DE 1118011 B 11/1961
DE 1906503 A1 9/1969

(Continued)

OTHER PUBLICATIONS

Machine Translation of Bartels (Obtained from USPTO Search) (Year: 2025).*

(Continued)

*Primary Examiner* — Dominick L Plakkoottam
*Assistant Examiner* — Geoffrey S Lee
(74) *Attorney, Agent, or Firm* — Christopher J. Volkmann; KELLY, HOLT & CHRISTENSON PLLC

(57) ABSTRACT

Membrane pump device, wherein the membrane pump device comprises a housing, and the housing contains a first and a second chamber, wherein the first chamber is separated from the second chamber by a movable membrane, while a liquid being pumped can be introduced in the first chamber, and a drive liquid can be introduced into the second chamber, wherein the second chamber has an outlet opening, and the outlet opening is present on an outer side of the housing. The membrane pump device is characterized in that the membrane pump device comprises a valve, while the valve is arranged at the outlet opening and closes off the second chamber from the outside.

15 Claims, 2 Drawing Sheets

(58) Field of Classification Search
CPC ..... B05B 15/58; B05B 15/65; B05B 13/005; B08B 3/026; F02D 2009/023
See application file for complete search history.

(56) References Cited

U.S. PATENT DOCUMENTS 3,702,684 A * 11/1972 Bevengut ..... F04F 5/24 239/416.5
3,805,526 A * 4/1974 Charron ..... F16H 39/06 418/21
3,937,400 A * 2/1976 Krause ..... B05B 5/1608 239/323
3,961,860 A * 6/1976 Ernst ..... F04B 43/107 417/388
RE29,055 E * 11/1976 Wagner ..... F04B 43/067 417/388
4,365,745 A * 12/1982 Beck ..... F04B 43/073 417/387
4,403,924 A * 9/1983 Gebauer ..... F04B 43/067 417/388
4,604,037 A 8/1986 Hoya
4,828,464 A * 5/1989 Maier ..... F04B 43/067 417/63
5,056,036 A * 10/1991 Van Bork ..... G05D 7/005 700/282
5,246,351 A * 9/1993 Horn ..... F04B 43/067 417/387
7,278,450 B1 * 10/2007 Condon ..... F16L 55/1108 285/348
10,378,530 B2 * 8/2019 Arnold ..... F04B 43/009
2021/0148354 A1 * 5/2021 Adams ..... F04B 45/0533
2021/0231113 A1 * 7/2021 Jansen ..... F04B 11/0016

FOREIGN PATENT DOCUMENTS

DE 116148 A5 11/1975
DE 3134911 A1 3/1983
DE 20311304 U1 9/2003
DE 102010013107 A1 9/2011
DE 102011114554 A1 4/2013
WO WO-2009059664 A1 * 5/2009 ..... F04B 19/006

OTHER PUBLICATIONS

Search Report for German Patent Application No. 10 2021 133 514.0, dated Sep. 29, 2022, 5 pages.

* cited by examiner

MEMBRANE PUMP DEVICE

CROSS-REFERENCES TO RELATED APPLICATION

This application claims the benefit of German Application No. 10 2021 133 514.0, filed Dec. 16, 2021.

BACKGROUND

Membrane pump devices are already known. Known membrane pump devices are used for example to drive paint spraying systems, e.g., for road marking equipment.

The shortcoming of the known membrane pump devices in use with the mentioned systems is that the setting of a pressure range is relatively cumbersome.

DETAILED DESCRIPTION

Figure 1:
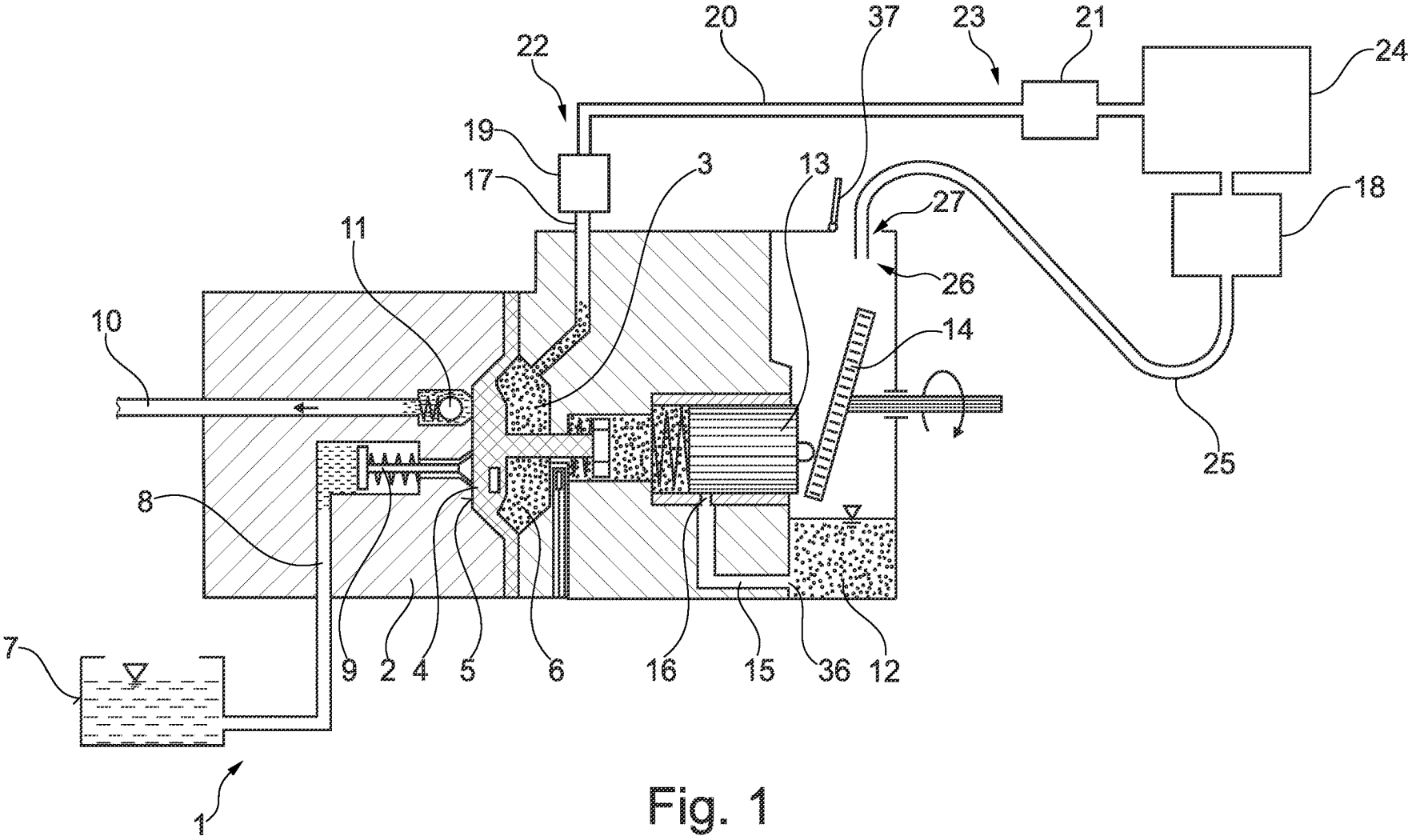
FIG. 1 shows a membrane pump device in a cross section, in one example.

The present disclosure is based on the problem of providing an improved membrane pump device. In particular, providing a membrane pump device by means of which the setting of a pressure range is made possible in relatively simplified manner.

This problem is solved by the features of claim 1.

Advantageous and expedient embodiments of the present disclosure are indicated in the dependent claims.

The present disclosure starts from a membrane pump device, wherein the membrane pump device comprises a housing, and the housing contains a first and a second chamber, wherein the first chamber is separated from the second chamber by a movable membrane, while a liquid being pumped can be introduced in the first chamber, and a drive liquid can be introduced into the second chamber, wherein the second chamber has an outlet opening, and the outlet opening is present on an outer side of the housing. For example, the membrane pump device is designed as a piston membrane pump.

An aspect of the present disclosure should be seen in that the membrane pump device comprises a valve, while the valve is arranged at the outlet opening and closes off the second chamber from the outside. For example, this makes possible a spatial displacement of a regulating valve for setting a pressure range of the membrane pump device, e.g., for setting a pressure range of the drive liquid. In this way, the membrane pump device can be designed relatively ergonomically.

For example, the valve seals off the second chamber from the outside. For example, the outlet opening is present on the housing in the form of a standard hydraulic port. For example, the outlet opening is configured as a screw connection, e.g., with an external thread or with an internal thread. For example, the valve is connected tight to the outlet opening.

It is further proposed that the valve is designed as a one-way valve. It is also conceivable for the valve to be present in the form of a check valve, a locking valve and/or a pressure valve, such as an overpressure valve. For example, this should make it easier to mount the membrane pump device on an apparatus containing the membrane pump device. For example, the apparatus is present as a paint application system.

It is likewise proposed that the membrane pump device comprises a collection chamber for collecting drive liquid, wherein the collection chamber is connected by a suction opening of the collection chamber to the second chamber, wherein the collection chamber has an inlet opening, wherein a closure element is present at the inlet opening for closing the inlet opening. For example, the closure element of the collection chamber makes it easier to mount the membrane pump device. For example, the closure element simplifies the mounting of the membrane pump device on an apparatus containing the membrane pump device.

For example, the closure element is formed as a cover, a hood, a plug and/or as a screen and/or as a valve and/or as a connection element (connector). It is also conceivable for the closure element to be present as an elastic sleeve. It is also conceivable for the collection chamber to have a connection element at the inlet opening and for the closure element to be present on the connection element. For example, the connection element is configured as a screw connection, e.g., with an external thread or with an internal thread.

Furthermore, it is proposed that the housing comprises the collection chamber and the inlet opening of the collection chamber is present or arranged on a housing outer side. For example, this achieves a compact design of the membrane pump device.

It is likewise proposed that the membrane pump device comprises a pressure hose, wherein the pressure hose is connected at a first end to the outlet opening. For example, this complies with safety requirements.

For example, the pressure hose is designed as a pressure-rigid hose, e.g., as a high-pressure hose. It is conceivable for the pressure hose to be present as an oil high-pressure hose. For example, the pressure hose is present as a hydraulic hose. It is also conceivable for the pressure hose to have a narrow volume.

A further exemplary embodiment of the membrane pump device comprises a pressure adjustment valve, wherein the pressure adjustment valve is connected to a second end of the pressure hose. For example, the membrane pump device has a better ergonomic design in this way, so that the setting of a pressure range is made more easily possible.

For example, by means of the pressure adjustment valve it is possible to set a pressure of the drive liquid in the second chamber. For example, by means of the pressure adjustment valve a maximum pressure of the drive liquid in the second chamber can be set.

It is likewise proposed that the membrane pump device comprises a throttle valve, wherein the throttle valve is present between the outlet opening of the housing and the pressure adjustment valve. For example, the flow in the pressure hose can be quieted in this way, so that the pressure adjustment valve is protected.

For example, the throttle valve is present at the second end of the pressure hose. Advantageously, the throttle valve connects the pressure hose to the pressure adjustment valve. It is conceivable for the throttle valve at the second end of the pressure hose to be connected directly to the pressure hose. It is also conceivable for the throttle valve to be connected directly to the pressure adjustment valve.

It is likewise proposed that the membrane pump device comprises a settling chamber, wherein the settling chamber is present between the outlet opening of the housing and the pressure adjustment valve.

For example, the settling chamber is present at the second end of the pressure hose. Advantageously, the settling chamber connects the pressure hose to the pressure adjustment valve. It is also conceivable for the settling chamber to be present between the throttle valve and the pressure adjustment valve. It is furthermore conceivable for the settling chamber to connect the throttle valve directly to the pressure adjustment valve.

Furthermore, it is proposed that the membrane pump device comprises a return hose, wherein the return hose connects the pressure adjustment valve to the inlet opening of the collection chamber. For example, this makes it possible to supply to the collection chamber excess drive liquid which emerges from the outlet opening for regulating the pressure of the drive liquid via the pressure hose, the pressure adjustment valve and the return hose.

For example, the return hose is a large-volume hose. For example, this makes possible a disturbance-free return of the drive liquid.

It is also conceivable for an inner diameter of the inlet opening to be larger than an outer diameter of the return hose. For example, this makes possible a disturbance-free inflow to the collection chamber. It is also conceivable for the closure element to connect the inlet opening of the collection chamber tightly to the return hose.

It is also proposed that the pressure hose and the return hose are connected to each other as a unit. For example, this simplifies the assembly of the membrane pump device. For example, this realizes a compact design of the membrane pump device.

For example, the pressure hose and the return hose are joined together like a strand. For example, the pressure hose and the return hose are encased by a jacket element. For example, the jacket element is present as a textile hose.

It is also conceivable for the pressure hose and the return hose to be formed as a twin hose.

For example, the pressure hose has a length of 0.05 m to 3 m between the valve and the pressure adjustment valve. It is also conceivable for the pressure hose to have a length of 0.1 m to 2 m between the valve and the pressure adjustment valve. It is conceivable for the pressure hose to be 0.1 m, 0.2 m, 0.3 m, 0.4 m, 0.5 m, 0.6 m, 0.7 m, 0.8 m, 0.9 m, 1 m, 1.5 m or 2 m in length. It is also conceivable for the pressure hose to have a length of up to 0.1 m, 0.2 m, 0.3 m, 0.4 m, 0.5 m, 0.6 m, 0.7 m, 0.8 m, 0.9 m, 1 m, 1.5 m, 2 m, 2.5 m or 3 m.

Furthermore, a paint application system comprising a frame element and a membrane pump device according to one of the previously mentioned embodiments is proposed.

For example, the paint application system is configured as a paint spraying system, or as a road marking apparatus. For example, the membrane pump device is mounted on the frame element of the paint application system, and the pressure adjustment valve is arranged on the frame element at a distance from the housing of the membrane pump device. It is furthermore conceivable for wheels to be provided on the frame element, in order to move the paint application system more easily by means of the wheels.

It is also conceivable for the frame element to have an operating area, such as a handle, and for the pressure adjustment valve to be situated on the operating area, e.g., on the handle.

An exemplary embodiment will be explained more closely with the aid of the following drawings, indicating further details and benefits.

FIG. 1 shows a membrane pump device 1, which serves e.g. to deliver a liquid, such as paint, from a storage tank 7 to a consumer, not shown.

For example, the membrane pump device 1 comprises a housing 2 with a movable membrane 4. For example, the membrane 4 separates from each other a first chamber 5 for the liquid being supplied and a second chamber 6, the chamber 6 being filled with drive liquid 3. For example, a piston 13 is provided to drive the membrane 4, the piston being activated to oscillate by a swashplate 14, so that the membrane 4 is alternately placed under pressure and relieved by the drive liquid 3 located in the second chamber 6.

For example, the liquid being supplied is sucked during a suction stroke of the membrane 4 across a suction line 8 and an inlet valve 9 installed in this, which opens in the process, from the storage tank 7 and into the first chamber 5. For example, in a following pressure stroke, the liquid sucked in is delivered across an outlet valve 11, which is closed during the suction stroke, to a pressure line 10 leading to the consumer.

For example, the second chamber 6 is connected by a suction line 15 and an inlet valve 16 situated therein to a collection chamber 12 across a suction opening 36 of the collection chamber 12. For example, the piston 13 on its return stroke sucks drive liquid 3 from the storage chamber 12 into the second chamber 6, while during its advancing stroke the drive liquid 3 acts in the form of a hydraulic ram on the membrane 4, so that the membrane 4 is displaced in synchronously oscillating movements.

It is conceivable for the collection chamber 12 to be integrated in the housing 2 of the membrane pump device 2. However, it is also conceivable for the housing 2 and the collection chamber 12 to be present independently of each other.

For example, the membrane pump device 1 comprises an outlet opening 17 on the housing 2, which is connected to the second chamber 6, so that drive liquid 3 can emerge from the second chamber 6 through the outlet opening 17. For example, a valve 19 is present at the outlet opening 17. The valve 19 is for example designed as an excess pressure valve. For example, the valve 19 makes it possible for drive liquid 3 to escape through the outlet opening 17 and the valve 19 from the second chamber 6 from a certain pressure.

For example, the valve 19 is connected by means of a pressure hose 20 to a throttle valve 21. For example, the pressure hose 20 is connected at a first end 22 to the valve 19 and by a second end 23 to the throttle valve 21. It is further conceivable for a settling chamber 24 to be present between the throttle valve 21 and a pressure adjustment valve 18.

For example, a return hose 25 is furthermore present, which connects the pressure adjustment valve 18 to the collection chamber 12. For example, the return hose 25 reaches by one end 26 through an inlet opening 27 of the collection chamber 12. It is furthermore conceivable for the collection chamber 12 to have a closure element 37. For example, the closure element 37 is formed as a flap or as a cover at the inlet opening 27, so that the inlet opening 27 can be removably closed with the closure element 37.

Figure 2:
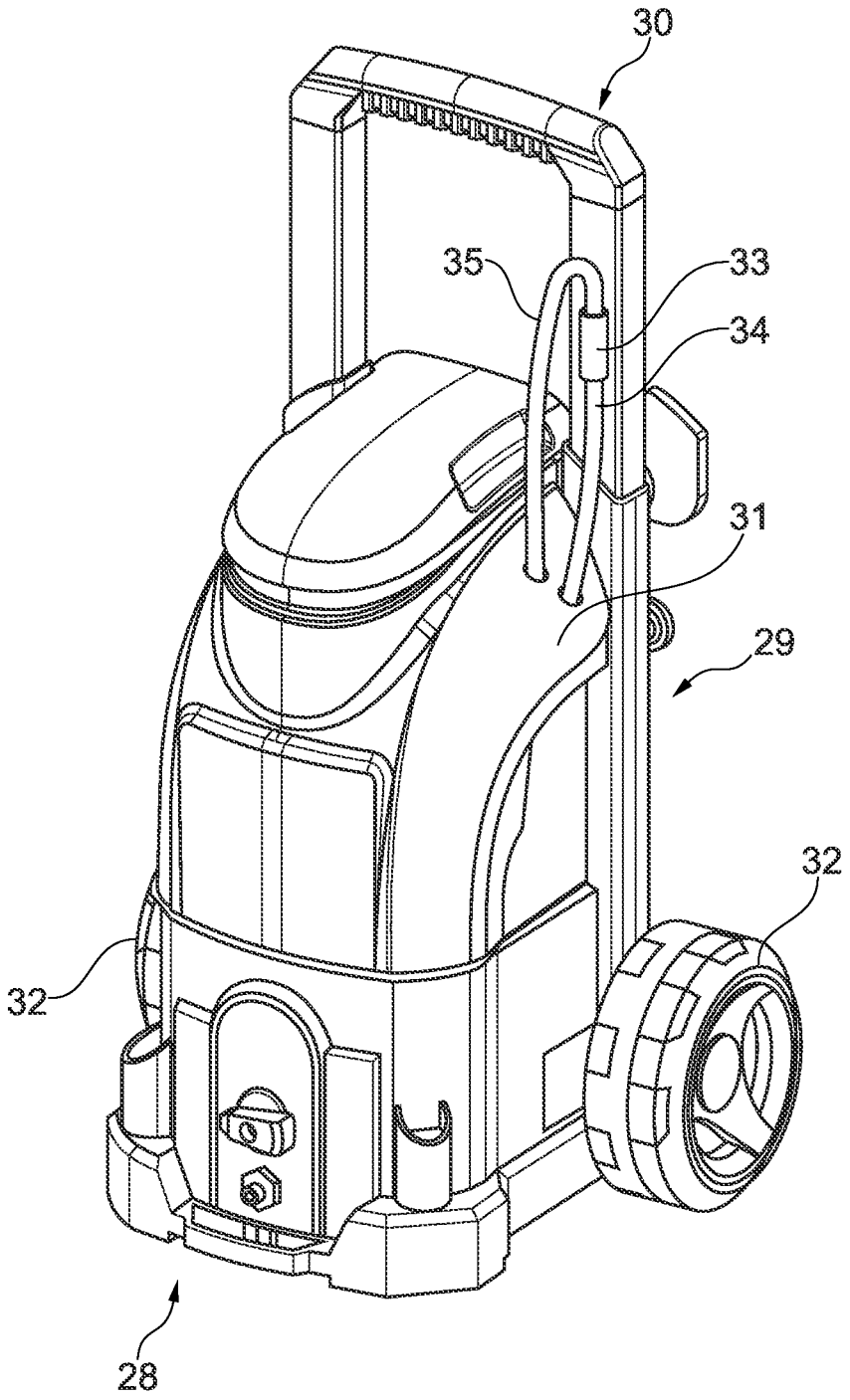
FIG. 2 shows a paint application system with a membrane pump device in a perspective front view, in one example.

FIG. 2 shows a paint application system 28 with a membrane pump device according to the present disclosure. For example, the paint application system 28 comprises a frame element 29 with an operating area 30. It is also conceivable for the paint application system to have wheels 32. For example, the operating area 30 is designed as a handle.

For example, a housing (not visible) of the membrane pump device is situated beneath a cover 31 of the paint application system 28 and a pressure adjustment valve 33 is situated on the frame element 29. For example, the pressure adjustment valve 33 is situated in the region of the operating area 30 or on the operating area 30.

For example, the pressure adjustment valve 33 is connected by means of a pressure hose 34 to the housing (not shown) and connected by means of a return hose 35 to a collection chamber (not shown).

Although the present invention has been described with reference to preferred embodiments, workers skilled in the art will recognize that changes may be made in form and detail without departing from the spirit and scope of the invention.

LIST OF REFERENCE NUMBERS

| | |
|---|---|
| 1 | Membrane pump device |
| 2 | Housing |
| 3 | Drive liquid |
| 4 | Membrane |
| 5 | Chamber |
| 6 | Chamber |
| 7 | Storage tank |
| 8 | Suction line |
| 9 | Inlet valve |
| 10 | Pressure line |
| 11 | Outlet valve |
| 12 | Collection chamber |
| 13 | Piston |
| 14 | Swashplate |
| 15 | Suction line |
| 16 | Inlet valve |
| 17 | Outlet opening |
| 18 | Pressure adjustment valve |
| 19 | Valve |
| 20 | Pressure hose |
| 21 | Throttle valve |
| 22 | End |
| 23 | End |
| 24 | Settling chamber |
| 25 | Return hose |
| 26 | End |
| 27 | Inlet opening |
| 28 | Paint application system |
| 29 | Frame element |
| 30 | Operating area |
| 31 | Cover |
| 32 | Wheel |
| 33 | Pressure adjustment valve |
| 34 | Pressure hose |
| 35 | Return hose |
| 36 | Suction opening |
| 37 | Closure element |

The invention claimed is:

1. A membrane pump device comprising:

a housing having an outer perimeter defining a housing inner portion, wherein the housing inner portion comprises:

a first chamber and a second chamber, wherein the first chamber is separated from the second chamber by a movable membrane, while a liquid being pumped can be introduced in the first chamber, and a drive liquid can be introduced into the second chamber, wherein the second chamber has an outlet opening present on an outer side of the outer perimeter of the housing;

a piston configured to introduce the drive liquid into the second chamber;

a drive component configured to drive the piston; and a collection chamber configured to collect the drive liquid, wherein the collection chamber has an inlet opening;

an overpressure valve arranged at the outlet opening and configured to close off the second chamber from outside the outer perimeter of the housing, wherein the overpressure valve is configured to release the drive liquid when a pressure within the second chamber exceeds a pressure threshold;

a pressure hose located outside the outer perimeter of the housing, the pressure hose having a first end and a second end, wherein the first end is connected to the outlet opening;

a pressure adjustment valve located outside the outer perimeter of the housing and downstream of the overpressure valve, the pressure adjustment valve configured to adjust a downstream pressure of the liquid; and a return hose that connects the pressure adjustment valve to the inlet opening of the collection chamber, wherein the pressure adjustment valve is configured to control a return flow of drive liquid to the collection chamber through the return hose to set a pressure of the drive liquid.

2. The membrane pump device according to claim 1, wherein the overpressure valve is designed as a one-way valve.

3. The membrane pump device according to claim 2, wherein the piston, during a return stroke, enters the collection chamber.

4. The membrane pump according to claim 3, wherein the piston, during an advancing stroke, exits the collection chamber.

5. The membrane pump device according to claim 1, wherein the collection chamber is connected by a suction opening of the collection chamber to the second chamber, wherein a cover is present at the inlet opening for closing the inlet opening.

6. The membrane pump device according to claim 5, wherein the housing comprises the collection chamber and the inlet opening is arranged on the outer side of the outer perimeter of the housing.

7. The membrane pump device according to claim 1, wherein the membrane pump device comprises a throttle valve, wherein the throttle valve is present between the outlet opening of the housing and the pressure adjustment valve.

8. The membrane pump device according to claim 1, wherein the membrane pump device comprises a settling chamber, wherein the settling chamber is present between the outlet opening of the housing and the pressure adjustment valve.

9. The membrane pump device according to claim 1, wherein the pressure hose and the return hose are connected to each other as a unit.

10. A paint application system comprising:

a frame element;

a housing having an outer perimeter defining a housing inner portion, wherein the housing inner portion comprises:

a first chamber and a second chamber, wherein the first chamber is separated from the second chamber by a movable membrane, while a liquid being pumped can be introduced in the first chamber, and a drive liquid can be introduced into the second chamber, wherein the second chamber has an outlet opening configured to extend through the outer perimeter;

a piston configured to introduce the drive liquid into the second chamber;

a drive component configured to drive the piston; and a collection chamber configured to collect the drive liquid, wherein the collection chamber has an inlet opening;

an overpressure valve arranged at the outlet opening and configured to close off the second chamber from outside the outer perimeter of the housing, wherein the overpressure valve is configured to release the drive liquid when a pressure within the second chamber exceeds a pressure threshold;

a pressure hose located outside the outer perimeter of the housing, the pressure hose having a first end and a second end, wherein the first end is connected to the outlet opening;

a throttle valve located outside the outer perimeter of the housing and downstream of the overpressure valve, the throttle valve configured to reduce a flow rate of the liquid;

a settling chamber located downstream the throttle valve, the settling chamber configured to receive fluid from the throttle valve and stabilize a pressure the fluid;

a pressure adjustment valve located outside the outer perimeter of the housing and downstream the settling chamber, the pressure adjustment valve configured to regulate the pressure of the fluid; and a return hose that connects the pressure adjustment valve to the inlet opening of the collection chamber, wherein the pressure adjustment valve is configured to control a return flow of drive liquid to the collection chamber through the return hose to set a pressure of the drive liquid.

11. The paint application system according to claim 10, wherein the valve is designed as a one-way valve.

12. The paint application system according to claim 10, wherein the collection chamber is connected by a suction opening of the collection chamber to the second chamber, wherein a cover is present at the inlet opening for closing the inlet opening.

13. The paint application system according to claim 12, wherein the housing comprises the collection chamber and the inlet opening is arranged on an outer side of the outer perimeter of the housing.

14. The paint application system according to claim 10, wherein the throttle valve is present between the outlet opening of the housing and the pressure adjustment valve.

15. The paint application system according to claim 10, wherein the pressure hose and the return hose are connected to each other as a unit.

* * * * *